US007481750B2

(12) United States Patent
Fishel

(10) Patent No.: US 7,481,750 B2
(45) Date of Patent: Jan. 27, 2009

(54) EXERCISE MACHINE

(76) Inventor: Jeffery C. Fishel, 535 E. State Route 133, Arcola, IL (US) 61910

( * ) Notice: Subject to any disclaimer, the term of this patent is extended or adjusted under 35 U.S.C. 154(b) by 0 days.

(21) Appl. No.: 11/800,291

(22) Filed: May 4, 2007

(65) Prior Publication Data

US 2007/0275835 A1 Nov. 29, 2007

Related U.S. Application Data

(60) Provisional application No. 60/802,925, filed on May 24, 2006.

(51) Int. Cl.
*A63B 21/068* (2006.01)
*A63B 21/02* (2006.01)
*A63B 21/00* (2006.01)

(52) U.S. Cl. ..... 482/95; 482/122; 482/135

(58) Field of Classification Search ..... 482/100, 482/130, 133–135, 95, 96, 122, 137
See application file for complete search history.

(56) References Cited

U.S. PATENT DOCUMENTS 4,666,152 A * 5/1987 Jones ..... 482/137
5,070,863 A * 12/1991 McArthur et al. ..... 601/26
5,100,131 A * 3/1992 Fong ..... 482/112
6,387,024 B1 * 5/2002 Monti et al. ..... 482/142
6,811,522 B1 * 11/2004 McQuinn ..... 482/143
6,939,272 B1 9/2005 Wu ..... 482/92
2002/0022556 A1 * 2/2002 Eriksson et al. ..... 482/92

* cited by examiner

*Primary Examiner*—Loan H Thanh
*Assistant Examiner*—Allana Lewin
(74) *Attorney, Agent, or Firm*—Philip L. Bateman

(57) ABSTRACT

A floor standing exercise machine enables a user to perform an assisted back extension to exercise his lower back. The exercise machine contains: (a) a frame; (b) a stationary pad angled at about 30 to 60 degrees to the floor for supporting the user's lower body; (c) a footrest for supporting the user's feet; (d) a horizontal restraint bar for restraining the user's lower body against the stationary pad; (e) a pivoting pad connected to the top of the stationary pad, the pivoting pad being movable between a first position parallel to the stationary pad to a second position that is angled downward from the first position; (f) a means for providing a sufficient upward force to the pivoting pad to hold the pivoting pad in the first position when not in use; (g) a means for providing an adjustable upward force to the pivoting pad that partially offsets a downward gravitational force exerted by the user's upper torso.

14 Claims, 4 Drawing Sheets

EXERCISE MACHINE

CROSS-REFERENCE TO RELATED APPLICATION

This application claims the benefit of U.S. Provisional Application Ser. No. 60/802,925, May 24, 2006.

FIELD OF THE INVENTION

This invention relates to exercise machines. More particularly, this invention relates to exercise machines for performing assisted back extensions.

BACKGROUND OF THE INVENTION

Humans are the only mammals that regularly walk upright on two legs. Walking upright creates many advantages that have enabled our species to succeed. However, walking upright also imposes increased loads on the lower back muscles because they must help support the upper torso. As a consequence, lower back problems due to weak lower back muscles are very common. Lower back problems are especially common among men. For this reason and for brevity, masculine pronouns are used herein.

A variety of exercises are commonly performed to strengthen the lower back muscles. In one common exercise, the user sits on a machine with a movable pad resting against his lower back. The lower back pad is connected to a stack of weights so that its resistance to movement can be varied. The user exercises the lower back by leaning backwards to move the pad against the resistance. This exercise is not advisable for users with spinal column problems because the motion causes compression of the discs in the spinal column.

Another common exercise is known as a back extension or hyperextension. The user faces downward on a bench (commonly known as a Roman chair) that supports his lower body. The bench may be horizontal or may be angled. The user then lowers the upper body by pivoting forward and downward, and then raises his upper body back to the starting position. The weight of the user's upper body (the downward gravitational force) provides the resistance to the upward motion. The back extension does not compact the spinal column and additional resistance is easily added by the user extending his arms or holding a weight.

Unfortunately, many persons with lower back problems have insufficient strength to perform an unassisted back extension. In other words, their lower back muscles are too weak to lower and raise their upper bodies. The only way such persons can perform back extensions is to have another person, such as a physical therapist, trainer, or partner, assist the motion by lifting the upper body. The term "assist" is used herein to refer to anything that reduces the muscular force needed to raise the upper body when performing a back extension. In other words, the term is not used to connote the presence of another person.

Wu, U.S. Pat. No. 6,939,272, Sep. 6, 2005, discloses an exercise machine for performing abdominal and lower back exercises. The machine contains a stationary pad and a pivoting pad. The movement of the pivoting pad is resisted by the stack of weights. A large number of exercises are performed on the machine. FIG. 15 illustrates an exercise for the lower back in which the user lays on his back and moves the pivoting pad downward. FIG. 16 illustrates an exercise for the abdominal muscles in which the user lays on his stomach and moves the pivoting pad downward. Wu does not disclose the use of the machine for back extensions.

Accordingly, there is a demand for an exercise machine that provides variable assistance, rather than resistance, to a user performing a back extension. There is also a demand for a method of performing assisted back extensions without the presence of another person.

SUMMARY OF THE INVENTION

One general object of this invention is to provide an improved exercise machine for the lower back. A more particular object is to provide an exercise machine that provides variable assistance to a user performing a back extension. Another general object is to provide an improved method of exercising the lower back.

I have invented an improved floor standing exercise machine for performing an assisted back extension to exercise a user's lower back. The exercise machine comprises: (a) a frame having a base adapted for standing on a floor; (b) a stationary pad supported by the frame at an angle of about 30 to 60 degrees to the floor, having a top and a bottom, and being adapted for supporting the user's lower body when the user's thighs and hips are rested upon the stationary pad; (c) a means for supporting the user's feet; (d) a means for restraining the user's lower body against the stationary pad; (e) a pivoting pad having a top and a bottom, the bottom of the pivoting pad being pivotably connected near the top of the stationary pad, the pivoting pad being movable between a first position that is about parallel to the stationary pad and a second position that is angled downward from the first position; (f) a means for providing a constant upward force to the pivoting pad that is sufficient to hold the pivoting pad in the first position when not in use; and (g) a means for providing an adjustable upward force to the pivoting pad that partially offsets a downward gravitational force exerted by the user's upper torso.

I have also invented an improved method of exercising the lower back of a user. The method comprises: (a) obtaining a machine comprising: (i) a floor standing frame; (ii) a stationary pad for supporting the user's lower body, the stationary pad being supported by the frame at an angle of about 30 to 60 degrees to horizontal and having a top and a bottom; (iii) a footrest for supporting the user's feet; (iv) a restraint for restraining the user's lower body against the stationary pad; (v) a pivoting pad for supporting the user's upper body, the pivoting pad having a top and a bottom, the bottom of the pivoting pad being pivotably connected near the top of the stationary pad, the pivoting pad being movable between a first position about parallel to the stationary pad and a second position angled downward from the first position; and (vi) a provider of an adjustable upward force to the pivoting pad that assists the user in moving the pivoting pad from the second position to the first position by partially offsetting the downward gravitational force exerted by the user's upper body, the upward force provider selected from the group consisting of weights, springs, pneumatic cylinders, and flexible bands; (b) climbing onto the machine with the lower body against the stationary pad and the upper body against the pivoting pad; (c) leaning the upper body forward and downward; and (d) raising the upper body back with the assistance of the upward force exerted upon the pivoting pad by the upward force provider.

The exercise machine and the method of this invention enable a user to exercise his lower back by performing back extensions with variable assistance without the presence of another person.

DETAILED DESCRIPTION OF THE INVENTION

Figure 1:
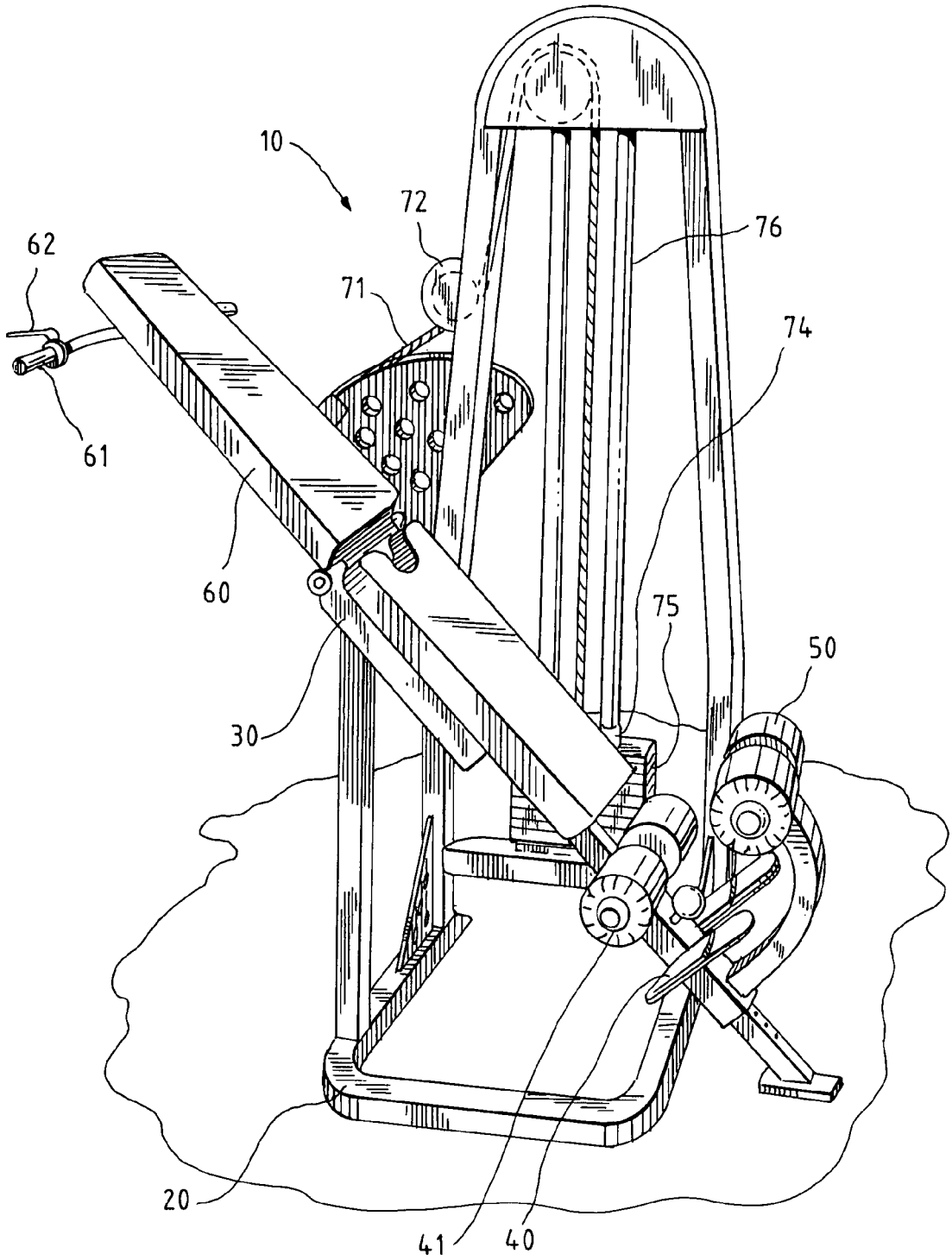
FIG. 1 is a perspective view of a preferred embodiment of the exercise machine of this invention.
Figure 2:
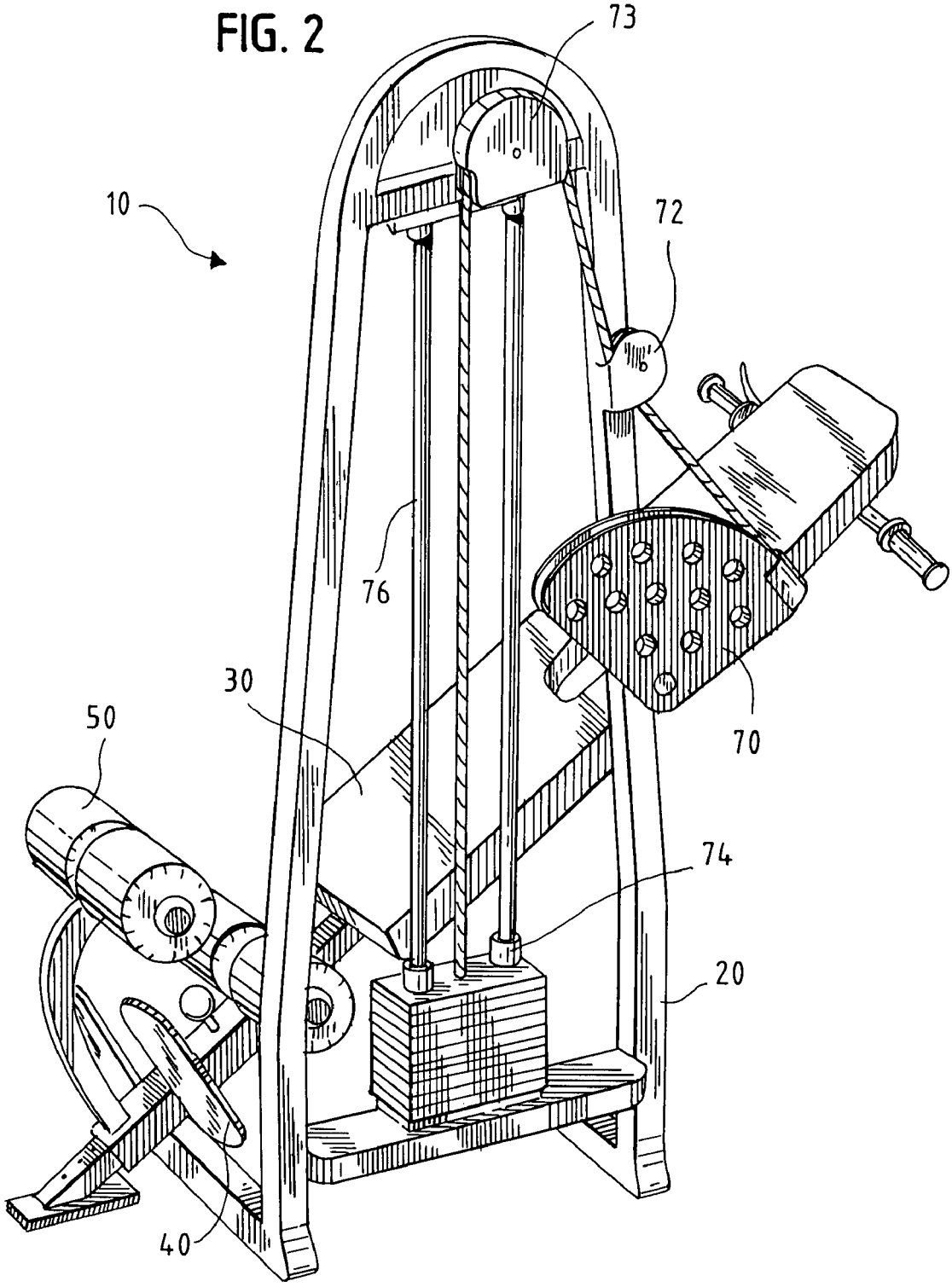
FIG. 2 is a perspective view thereof from a different angle.
Figure 3:
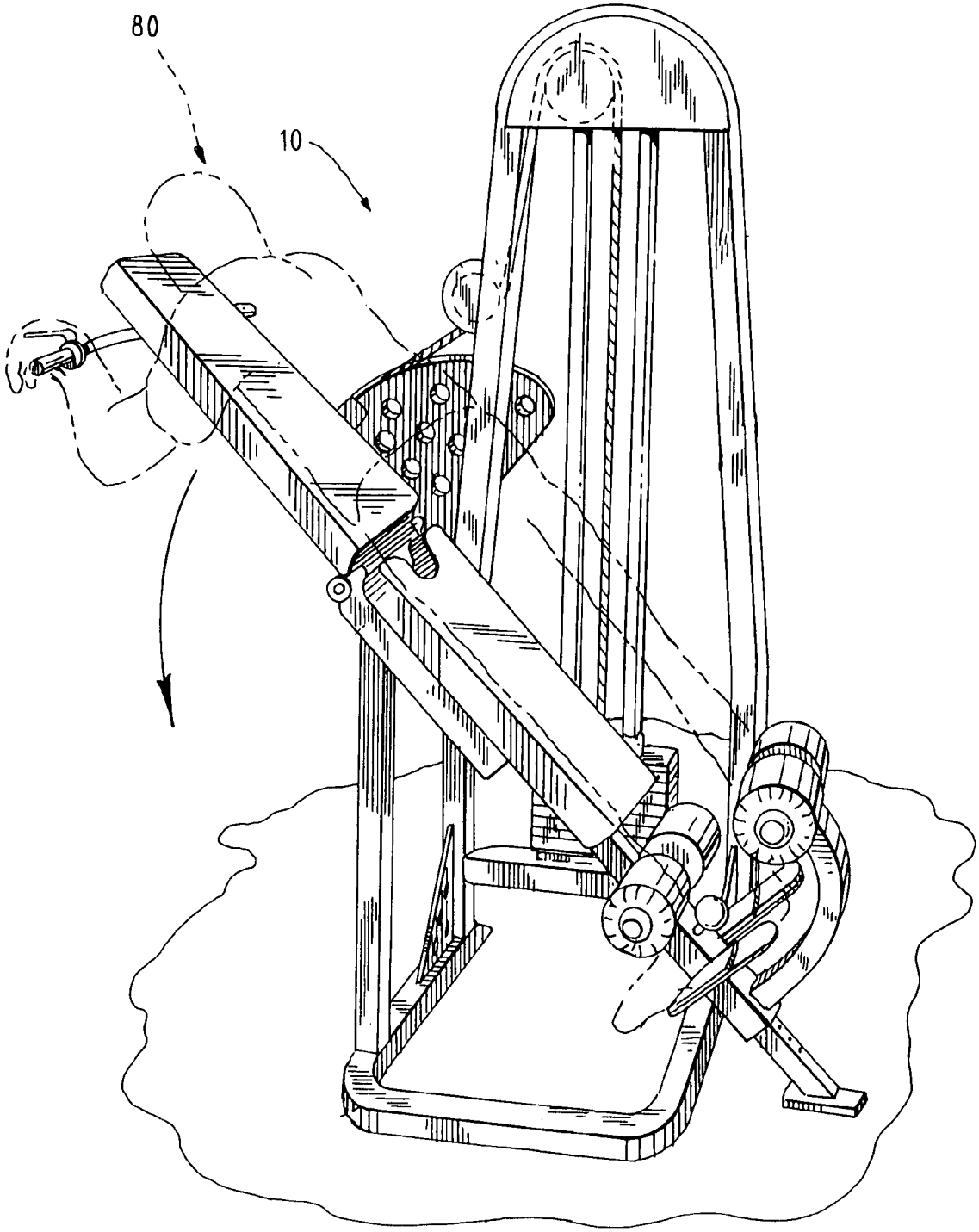
FIG. 3 is a perspective view thereof with a user in a first position.
Figure 4:
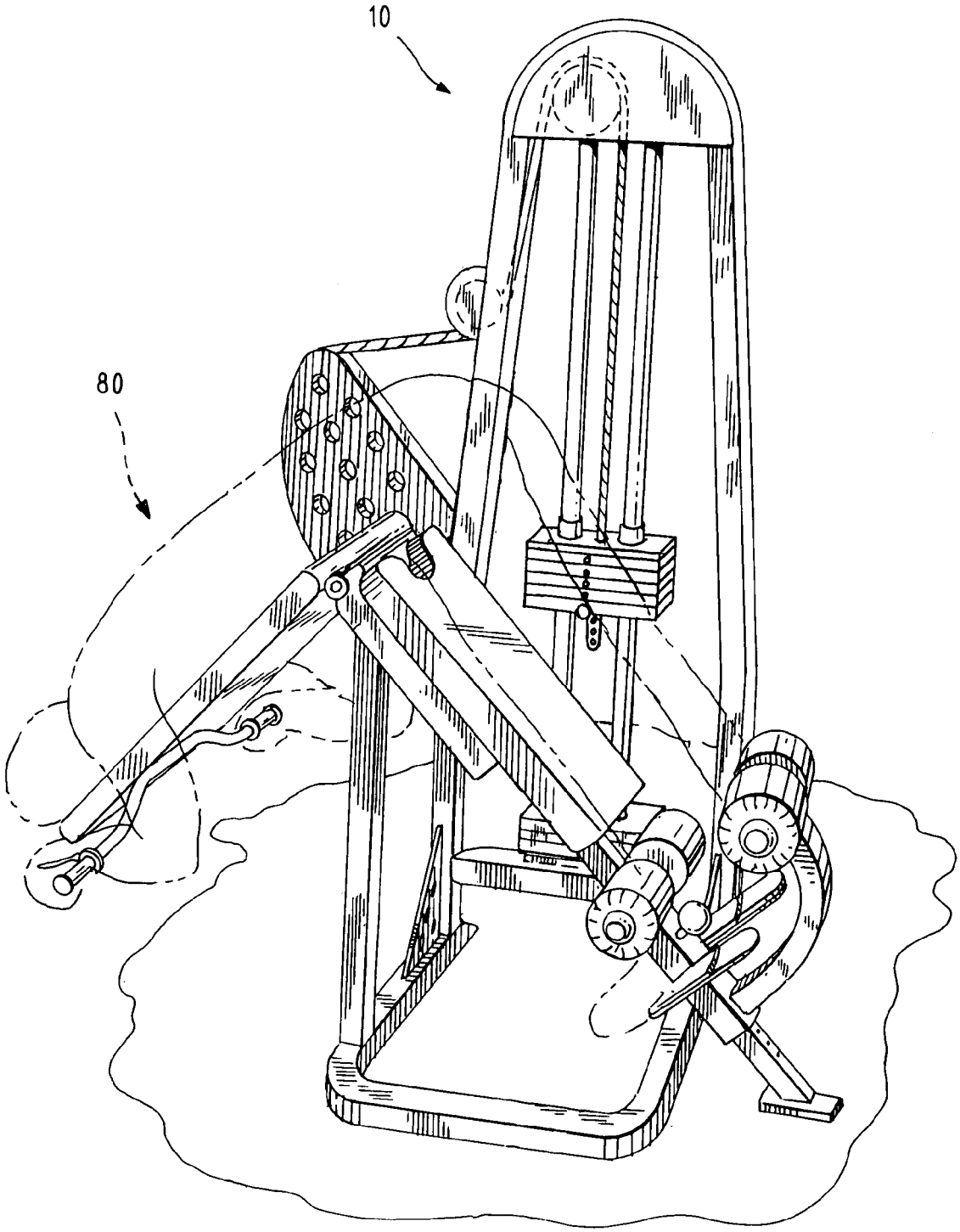
FIG. 4 is a perspective view thereof with a user in a second position.

This invention is best understood by reference to the drawings. Referring first to FIGS. 1 to 2, a preferred embodiment of the exercise machine 10 of this invention comprises a frame 20, a stationary pad 30, a footrest 40, a restraint bar 50, a pivoting pad 60, a weight stack cap 74 for providing a sufficient upward force to the pivoting pad to hold it parallel to the stationary pad when not in use, and additional weights 75 for providing an adjustable upward force to the pivoting pad. Each of these components is discussed in more detail below. In FIGS. 3 and 4, the exercise machine is illustrated being used by a user.

The frame 20 provides the overall structure to the exercise machine. The frame contains a base that stands (rests) upon a floor. In the preferred embodiment, the frame is U-shaped. The frame also contains supporting members for the stationary pad, the footrest, and the restraint bar. The frame further contains vertical support members that support the stack of weights and a pulley system connecting the pivoting pad to the weights. The frame is made of a strong, durable material. The frame is preferably made of steel.

The stationary pad 30 supports the lower body of the user. The stationary pad is generally angled at about 30 to 60 degrees, preferably about 45 degrees, to the floor. This angle provides the optimal ergonomics for the user performing back extensions. As seen in FIG. 3, the user's thighs and hips rest upon the stationary pad during use. The stationary pad is preferably padded for the comfort of the user. The stationary pad is preferably about twenty-four inches in length and about twelve inches in width.

The foot rest 40 places the feet of the user in a comfortable position. The foot rest is a flat platform that is preferably perpendicular to both the stationary pad and to the position of the user's legs. In the preferred embodiment, the foot rest includes a forward padded bar 41 against which the user's lower leg rests. If desired, the height of the foot rest is adjustable. The position of the foot rest affects the pivot point, or fulcrum, of the user as extensions are performed. As the foot rest lowers, the pivot point along the user's lumbar spine raises, and vice versa.

The restraint 50 helps to hold the user against the stationary pad. The restraint is preferably a horizontal bar located at a position behind the user's lower body. The restraint bar is preferably positioned so that it contacts the user's legs just above the ankles, at the Achilles' tendon. The restraint bar is preferably padded for the comfort of the user.

The pivoting pad 60 contacts the upper body of the user. The bottom of the pivoting pad is pivotably connected near the top of the stationary pad. In the preferred embodiment, the pivoting connection is a hinge consisting of a rod that rotates within a tube. The pivoting pad is preferably padded for the comfort of the user. When not is use, the pivoting pad preferably rests in a first position that is approximately parallel to the stationary pad (as shown in FIGS. 1 and 2). During use in performing a back extension, the pivoting pad moves downward about the pivot to a second position that is angled downward from the first position. The movement between the first and second positions defines the range of motion of the exercise. The range of motion is illustrated with arrows in FIG. 3. The range of motion is generally at least about 90 degrees and is preferably at least about 100 degrees and most preferably at least about 110 degrees. If desired, the range of motion of the pivoting pad is limited with stops or the like. The pivoting pad preferably contains outwardly extending handles 61 for the user to hold during use. One of the handles preferably contains a safety lever 62 that must be pulled to release a lock and allow the pivoting pad to move. This enables a user to climb onto the machine without the pivoting pad moving.

The exercise preferably contains a means for maintaining the pivoting pad in its first position (parallel to the stationary pad as shown in FIGS. 1 and 2) when not in use. Without such a means, the weight (the downward gravitational force) of the pivoting pad itself would cause it to drop down when not supported by a user. One way of maintaining the pad in this position is to provide a constant upward force to the pivoting pad that is sufficient to hold it in the first position when not in use. The upward force is preferably equal to or slightly greater than the weight of the pivoting pad so that only a small additional downward force is required to lower it. This force can be provided by the cap of the weight stack. Another way of maintaining the pad in the first position when not in use is to include a releasable lock or the like. The preferred embodiment of the exercise machine includes both means for maintaining the pivoting pad in the first position.

The exercise machine also includes a means for providing an adjustable upward force to the pivoting pad that partially offsets the downward gravitational force exerted by the user's upper body. This upward force assists, rather than restricts, the user as he performs a back extension exercise. When performing a back extension, the amount of the assisting, upwardly-directed force never exceeds the weight of (the downward gravitational force exerted by) the upper body so that the back muscles, rather than the abdominal muscles, are exercised.

The magnitude and direction of the forces can be illustrated by an example. If the weight of the pivoting pad is 50 pounds and the weight of the user's upper body is 100 pounds, the upward force needed to raise the upper body and the pivoting pad is 150 pounds. This upward force is provided by a combination of the machine and the lower back muscles of the user. Any upward force provided by the machine, up to 150 pounds, assists the user (reduces the muscular force) in raising his upper body and the pivoting pad while performing a back extension. As the upward force provided by the machine increases to 150 pounds, the required muscular force is correspondingly reduced. It can be appreciated that the lower back muscles are not exercised if the upward force provided by the machine exceeds 150 pounds. If the upward force exceeds the weight of user's upper body and the pivoting pad, the user must use his abdominal muscles to exert a downward force to move the pad.

The amount of the upward force provided by the machine is preferably adjustable so that the muscular force needed to raise the upper body and the pivoting pad is equal to about 10 to 90 percent of the weight of the user's upper body. For example, if the weight of the user's upper body is 100 pounds, the upward force provided by the machine is sufficient to reduce the upward force required by the user's lower back muscles to between about 10 to 90 pounds. The upward force provided by the machine, not including the upward force required to offset the weight of the pivoting pad, is typically adjustable between about 5 and 200 pounds to accommodate all sizes of users.

The upward forces required to support the pivoting pad and to provide assistance to the user are provided by means well known in the art such as weights, springs, pneumatic cylinders, flexible bands, or the like. In the preferred embodiment, both of the upward forces are combined in a single system that comprises a stack of weights connected to the pivoting pad by a pulley-and-cable linkage. Weight stacks are commonly used in exercise machines to provide variable resistance to an exercise. However, the weight stack in the lower back exercise machine of this invention provides variable assistance, rather than resistance, to the motion of the user.

In more detail, the preferred weight system comprises a curved guide member 70 that is connected to the pivoting pad so that it rotates as the pivoting pad moves. A cable 71 is attached to the guide member. The cable passes over a first pulley 72 and then upward to a second, overhead pulley 73. The cable then descends to a weight stack cap 74. The weight stack cap contains two upwardly extending tubular guides and a downwardly extending post with a series of spaced apart holes. The post extends through the stack 75 of weight plates. The weight of the cap alone provides a constant upward force that just barely exceeds the weight of the pivoting pad. The amount of assistance is set by inserting a pin into the post to include the desired number of weight plates. Two poles 76 pass through the tubular guides to provide a vertical path of travel for the weight stack cap and any accompanying weight plates.

The use of the exercise machine can now be considered. The user 80 climbs onto the machine facing forward and positions his feet on the footrest with his lower legs held by the horizontal restraint bar. The front of his legs and hips rest upon the stationary pad. His upper body is held in alignment with his lower body and his hands grasp the handles as shown in FIG. 3. To begin the back extension movement, the user pulls the lever and leans his upper body forward, which causes the pivoting pad to pivot downward as indicated by the arrows. The bottom point of the movement is shown in FIG. 4. The user then lifts his upper body back to the starting position. The amount of assistance provided to the motion is determined by the amount of weight on the weight stack. As the weight on the weight stack increases, the assistance increases.

As previously mentioned, the exercise machine of this invention enables a user to perform one or more back extensions who would not be able to do so without the assistance provided by the machine. Through regular use of the machine, a user can strengthen his lower back muscles and thereby reduce lower back pain. Exercises in addition to back extensions can be performed on the machine. For example, instead of lying face forward on the machine, a user can lie on his side and perform assisted lateral flexion movements to exercise the lower back muscles from a different angle. Passive range of motion exercises can be used in acute situations when any resistance exceeds pain thresholds or is otherwise inappropriate.

The exercise machine of this invention is a useful tool for muscle therapists, physical therapists, athletic trainers, and physicians. In addition to its use for exercise, rehabilitation, and therapy, it is an effective screening tool for kinetic chain assessment.

I claim:

1. A floor standing exercise machine for performing an assisted back extension to exercise a user's lower back, the exercise machine comprising:

(a) a frame having a base adapted for standing on a floor;

(b) a stationary pad supported by the frame at an angle of about 30 to 60 degrees to the floor, having a top and a bottom and a substantially planar front surface, and being adapted for supporting the user's lower body when the front of the user's thighs and hips are rested upon front surface of the stationary pad;

(c) a means for supporting the user's feet;

(d) a means for restraining the front of the user's thighs and hips against the stationary pad;

(e) a pivoting pad having a top and a bottom and a substantially planar front surface, the bottom of the pivoting pad being pivotably connected at the top of the stationary pad, the pivoting pad being movable between a first position in which its front surface is substantially parallel to the front surface of the stationary pad and a second position that is angled downward from the first position, and being adapted for movement with the user's upper torso when the chest of the user is placed upon the front surface of the pivoting pad;

(f) a releasable lock for holding the pivoting pad in the first position when not in use, the release of which allows the pivoting pad to drop to the second position without muscular force exerted by the user; and (g) a means for providing an adjustable upward mechanical force to the pivoting pad, the magnitude of which is variable from about zero to an amount that is about equal to a downward gravitational force exerted by a combination of the pivoting pad and the user's upper torso such that the pivoting pad is moved from the second position to the first position only by the user providing an upward muscular force, the magnitude of which is reduced by the magnitude of the adjustable upward force.

2. The exercise machine of claim 1 wherein the means for providing an adjustable upward force to the pivoting pad comprises weights, springs, pneumatic cylinders, or flexible bands.

3. The exercise machine of claim 2 wherein the means for providing an adjustable upward force to the pivoting pad comprises a weight stack connected to the pivoting pad by a cable and pulley system.

4. The exercise machine of claim 3 wherein movement of the pivoting pad between the first and second positions defines a range of motion of at least about 90 degrees.

5. An exercise machine for performing an assisted back extension to exercise a user's lower back, the exercise machine comprising:

(a) a frame;

(b) a stationary pad for supporting a user's lower body, the stationary pad being supported by the frame at an angle of about 30 to 60 degrees to horizontal and having a top and a bottom and a substantially planar front surface;

(c) a pivoting pad for supporting a user's upper body, the pivoting pad having a top and a bottom and a substantially planar front surface, the bottom of the pivoting pad being pivotably connected near the top of the stationary pad, the pivoting pad being movable between a first position in which its front surface is substantially parallel to the front surface of the stationary pad and a second position that is angled downward from the first position;

(d) a releasable lock for holding the pivoting pad in the first position when not in use, the release of which allows the pivoting pad to drop to the second position without muscular force exerted by the user; and (e) a provider of an adjustable upward mechanical force to the pivoting pad, the magnitude of which is variable from about zero to an amount that is about equal to a downward gravitational force exerted by a combination of the pivoting pad and the user's upper torso such that the pivoting pad is moved from the second position to the first position only by the user providing an upward muscular force, the magnitude of which is reduced by the magnitude of the adjustable upward force, the upward mechanical force provider selected from the group consisting of weights, springs, pneumatic cylinders, and flexible bands.

6. The exercise machine of claim 5 additionally comprising a footrest for supporting the user's feet and a restraint for restraining the user's lower body against the stationary pad.

7. The exercise machine of claim 6 additionally comprising a provider of a constant upward force to the pivoting pad that is sufficient to hold the pivoting pad in the first position when not in use.

8. The exercise machine of claim 7 wherein the provider of an adjustable upward force comprises a weight stack connected to the pivoting pad by a cable and pulley system.

9. The exercise machine of claim 8 wherein the movement of the pivoting pad between the first and second positions defines a range of motion of at least about 90 degrees.

10. A method for a user to perform an assisted back extension to exercise his lower back, the method comprising:

(a) obtaining a machine comprising:

(i) a floor standing frame;

(ii) a stationary pad for supporting the user's lower body, the stationary pad being supported by the frame at an angle of about 30 to 60 degrees to horizontal and having a top and a bottom and a substantially planar front surface;

(iii) a footrest for supporting the user's feet;

(iv) a restraint for restraining the user's lower body against the stationary pad;

(v) a pivoting pad for supporting the user's upper body, the pivoting pad having a top and a bottom and a substantially planar front surface, the bottom of the pivoting pad being pivotably connected near the top of the stationary pad, the pivoting pad being movable between a first position in which its front surface is substantially parallel to the front surface of the stationary pad and a second position that is angled downward from the first position;

(vi) a releasable lock for holding the pivoting pad in the first position when not in use, the release of which allows the pivoting pad to drop to the second position without muscular force exerted by the user; and (vii) a provider of an adjustable upward mechanical force to the pivoting pad, the magnitude of which is variable from about zero to an amount that about equals a downward gravitational force exerted by a combination of the pivoting pad and the user's upper torso such that the pivoting pad is moved from the second position to the first position only by the user providing an upward muscular force, the magnitude of which is reduced by the magnitude of the adjustable upward force, the upward mechanical force provider selected from the group consisting of weights, springs, pneumatic cylinders, and flexible bands;

(b) climbing onto the machine with the front of the hips and thighs against the stationary pad and the chest against the pivoting pad;

(c) leaning the upper body forward and downward to the second position; and (d) raising the upper body back to the first position with the assistance of the upward force exerted upon the pivoting pad by the upward mechanical force provider, such that the magnitude of the upward muscular force required is reduced by the magnitude of the adjustable upward force.

11. The method of claim 10 wherein the machine additionally comprises a provider of a constant upward force to the pivoting pad that is sufficient to hold the pivoting pad in the first position when not in use.

12. The method of claim 11 wherein the provider of an adjustable upward force comprises a weight stack connected to the pivoting pad by a cable and pulley system.

13. The method of claim 12 wherein the machine provides an adjustable upward force to the pivoting pad equal to 10 to 90 percent of the weight of the user's upper body.

14. The method of claim 13 wherein the movement of the pivoting pad between the first and second positions defines a range of motion of at least about 90 degrees.

* * * * *